US010487616B2

(12) United States Patent
Varkey et al.

(10) Patent No.: US 10,487,616 B2
(45) Date of Patent: Nov. 26, 2019

(54) PACKOFF SEALS AND PROCESSES FOR USING SAME

(71) Applicant: Schlumberger Technology Corporation, Sugar Land, TX (US)

(72) Inventors: Joseph Varkey, Sugar Land, TX (US); Jared Mangum, Richmond, TX (US); Ramadan Mansour, Houston, TX (US); Montie Wayne Morrison, Richmond, TX (US); Sheng Chang, Sugar Land, TX (US); Qingdi Huang, Sugar Land, TX (US); Gregory Au, Houston, TX (US); Daniel Hogan, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 191 days.

(21) Appl. No.: 15/635,766

(22) Filed: Jun. 28, 2017

(65) Prior Publication Data

US 2019/0003278 A1 Jan. 3, 2019

(51) Int. Cl.
*E21B 33/128* (2006.01)
*E21B 34/14* (2006.01)
(Continued)

(52) U.S. Cl.
CPC ..... *E21B 33/1285* (2013.01); *E21B 33/1208* (2013.01); *E21B 34/14* (2013.01);
(Continued)

(58) Field of Classification Search
CPC ..... E21B 34/08; E21B 34/14; E21B 33/122; E21B 33/1285; E21B 33/1208; E21B 43/38; E21B 43/045
(Continued)

(56) References Cited

U.S. PATENT DOCUMENTS 3,481,610 A * 12/1969 Slator ..... E21B 33/08 137/614.2
4,307,783 A * 12/1981 Lanmon, II ..... E21B 33/072 166/379
(Continued)

FOREIGN PATENT DOCUMENTS

WO 2013158260 A1 10/2013

OTHER PUBLICATIONS

International Search Report and Written Opinion issued in the related PCT application PCT/US2018/039882, dated Oct. 22, 2018 (19 pages).

*Primary Examiner* — David Carroll
(74) *Attorney, Agent, or Firm* — Eileen Pape

(57) ABSTRACT

Packoff seals and processes for using same. In some examples, the packoff seal can include a first end cap and a second end cap, a first insert and a second insert, a first deformable element disposed between the first end cap and the first insert, a second deformable element disposed between the second insert and the second end cap, and a third deformable element disposed between the first insert and the second insert. The first end cap, the first deformable element, the first insert, the third deformable element, the second insert, the second deformable element, and the second end cap together can form a body having a bore extending therethrough. The first deformable element, the second deformable element, and the third deformable element can have a compressive strength that is less than a compressive strength of the first and second inserts.

20 Claims, 5 Drawing Sheets

(51) Int. Cl.

| | |
|---|---|
| ***E21B 43/04*** | (2006.01) |
| ***E21B 33/12*** | (2006.01) |
| ***E21B 43/38*** | (2006.01) |
| *E21B 34/08* | (2006.01) |
| *E21B 33/122* | (2006.01) |

(52) U.S. Cl.
CPC ..... *E21B 43/045* (2013.01); *E21B 43/38* (2013.01); *E21B 33/122* (2013.01); *E21B 34/08* (2013.01)

(58) Field of Classification Search
USPC ..... 166/84.4, 84.3, 77.1
See application file for complete search history.

(56) References Cited

U.S. PATENT DOCUMENTS

| | | | | |
|---|---|---|---|---|
| 6,840,327 | B2 * | 1/2005 | Mitchell | E21B 21/00 166/387 |
| 2007/0158078 | A1 * | 7/2007 | Boyd | E21B 33/072 166/380 |
| 2007/0240877 | A1 | 10/2007 | OMalley et al. | |
| 2009/0101359 | A1 * | 4/2009 | Kauffman | E21B 33/072 166/379 |
| 2009/0159292 | A1 * | 6/2009 | Guerrero | E21B 33/068 166/373 |
| 2013/0277068 | A1 * | 10/2013 | Richard | E21B 33/1208 166/387 |
| 2015/0252638 | A1 | 9/2015 | Richards et al. | |
| 2016/0222752 | A1 | 8/2016 | Fripp et al. | |
| 2016/0298415 | A1 | 10/2016 | Takahashi et al. | |

* cited by examiner

PACKOFF SEALS AND PROCESSES FOR USING SAME

BACKGROUND

Field

Embodiments described generally relate to packoff seals and processes for using same.

Description of the Related Art

Oil and gas well servicing can involve inserting a tool into the wellbore to analyze geological formations around the wellbore, gather information about the hydrocarbon reservoir, determine the integrity of the wellbore, or for other reasons. The tool can be connected to a cable that is either a wireline, which has electrical conductors for sending and/or receiving data to the tool, or a slickline which does not include electrical conductors. These cables are typically connected to a winch at the surface and are used to lower and raise the tool in the wellbore.

As a safety precaution, a packoff assembly can be installed on the wellhead to assist in control of well pressure. The packoff assembly typically can include dual packoff seals for sealing around the cable while the tool is in the wellbore and while the winch lowers and raises the tool. The packoff assembly can be manually or remotely controlled using hydraulic pressure or can be activated automatically based on well pressure.

Conventional packoff seals include a piece of rubber molded into a generally cylindrical shape having a bore disposed therethrough along a central longitudinal axis thereof, which allows a cable to pass through the packoff seal. Often, heat and vibration generated after a couple of well servicing operations can cause deterioration of the rubber in the packoff seal leading to frequent replacement of conventional packoff seals.

There is a need, therefore, for packoff seals having improved resistance to deterioration during well servicing operations.

SUMMARY

Packoff seals and processes for using same are provided. In some examples, the packoff seal can include a first end cap and a second end cap, a first insert and a second insert, a first deformable element disposed between the first end cap and the first insert, a second deformable element disposed between the second insert and the second end cap, and a third deformable element disposed between the first insert and the second insert. The first end cap, the first deformable element, the first insert, the third deformable element, the second insert, the second deformable element, and the second end cap together can form a body having a bore extending therethrough. The first deformable element, the second deformable element, and the third deformable element can have a compressive strength that is less than a compressive strength of the first and second inserts.

In some examples, a packoff assembly, can include a packoff seal that can include a first end cap and a second end cap, a first insert and a second insert, a first deformable element disposed between the first end cap and the first insert, a second deformable element disposed between the second insert and the second end cap, and a third deformable element disposed between the first insert and the second insert. The first end cap, the first deformable element, the first insert, the third deformable element, the second insert, the second deformable element, and the second end cap together can form a body having a bore extending therethrough. In some examples, the first end cap can receive a longitudinal force from a well pressure along a longitudinal axis of the packoff seal, the first and second inserts can resist the longitudinal force and the first, second, and third deformable elements can deform in response to the longitudinal force to form three separate seals around a cable disposed within the bore. In some examples, a bellows can be disposed about the packoff seal and can apply a force radially inward to the packoff seal, the first and second inserts can resist the radially inward force and the first, second, and third deformable elements can deform in response to the radially inward force to form three separate seals around a cable disposed within the bore.

In some examples, a process for servicing a wellbore can include arranging a packoff assembly having a packoff seal around a cable. The cable can be extended into the wellbore to move a tool connected thereto in the wellbore. A force can be applied to the packoff seal to compress at least three deformable elements in the packoff seal against the cable. The at least three deformable elements can form separate seals around the cable when the force is applied to the packoff seal.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 1:
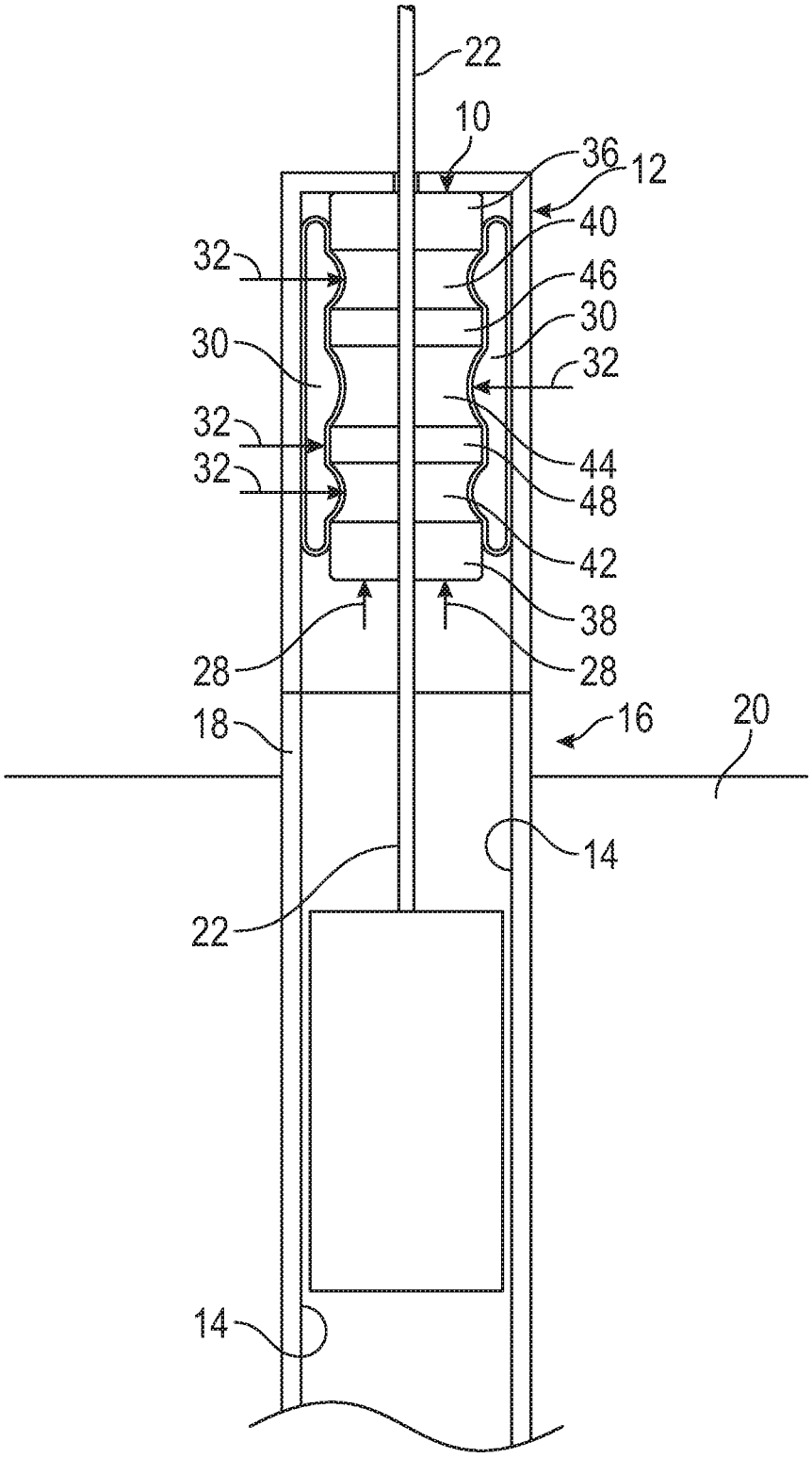
FIG. 1 depicts a cross-sectional view of an illustrative packoff assembly installed on a wellhead of a well that includes a packoff seal, according to one or more embodiments described.
Figure 2:
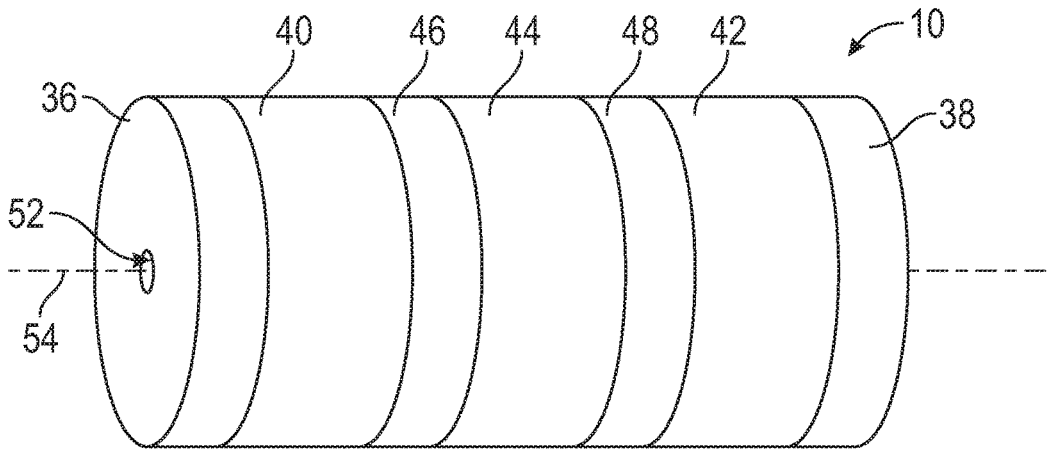
FIG. 2 depicts a perspective view of the packoff seal shown in FIG. 1 and separate from the packoff assembly.
Figure 3:
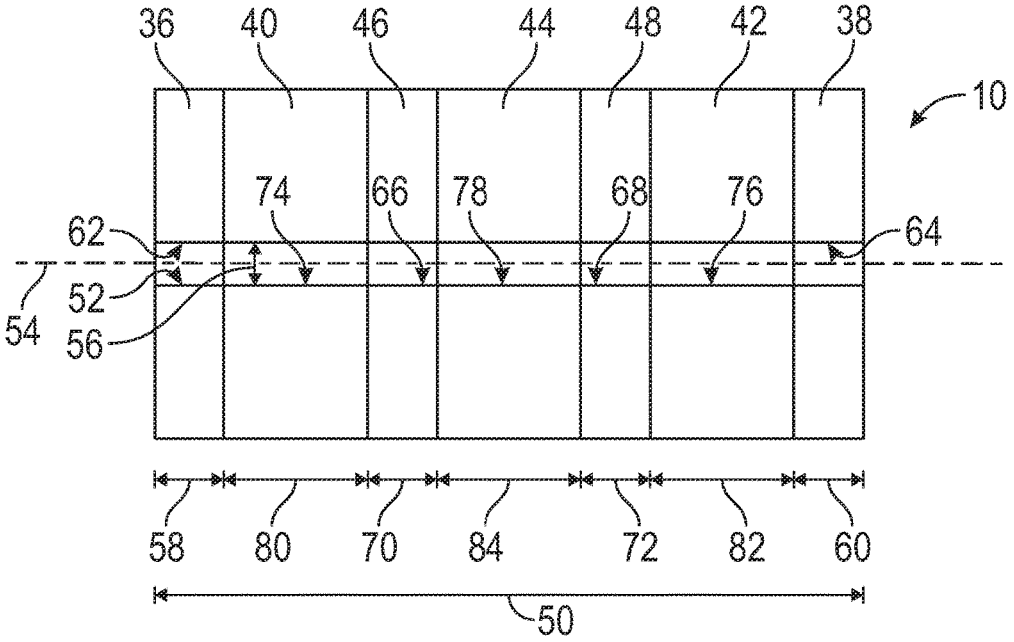
FIG. 3 depicts a cross-sectional view of the packoff seal shown in FIG. 2.

FIG. 1 depicts a cross-sectional view of an illustrative packoff assembly 12 installed on a wellhead 18 of a well 16 that can include one or more packoff seals 10 according to one or more embodiments. FIG. 2 depicts a perspective view of the packoff seal 10 shown in FIG. 1 and separate from the packoff assembly 12, according to one or more embodiments. FIG. 3 depicts a cross sectional view of the packoff seal 10 depicted in FIG. 2. The packoff seal 10 can include a first end cap 36 and a second end cap 38 that can be positioned at the ends of the packoff seal 10. The packoff seal 10 can also include two or more deformable elements (three are shown, i.e., a first deformable element 40, a second deformable element 42, and a third deformable element 44). The packoff seal 10 can also include one or more inserts (two are shown, i.e., a first insert 46 and a second insert 48) disposed between two deformable elements. For example, the first insert 46 can be positioned or otherwise at least partially disposed between the first deformable element 40 and the third deformable element 44. Similarly, the second insert 48 can be positioned or otherwise at least partially disposed between the second deformable element 42 and the third deformable element 44.

As shown, the first deformable element 40 can be positioned or otherwise at least partially disposed between the first end cap 36 and the first insert 46, the second deformable element 42 can be positioned or otherwise at least partially disposed between the second end cap 38 and the second insert 48, and the third deformable element 44 can be positioned or otherwise at least partially disposed between the first insert 46 and the second insert 48. The packoff seal 10 can have an overall length that can be represented by arrow 50. In some examples, the first and second inserts 46, 48 can be in the form or shape of an annular ring.

The packoff seal 10 can include one or more bores 52 disposed therethrough along a longitudinal axis 54 thereof. In some examples, the longitudinal axis 54 can be the central longitudinal axis of the packoff seal 10. The first end cap 36, the first deformable element 40, the first insert 46, the third deformable element 44, the second insert 48, the second deformable element 42, and the second end cap 38 together can form a body having the bore 52 extending therethrough. The bore 52 can have one or more cross-sectional lengths, e.g., diameters, illustrated by arrow 56, which can be dimensioned to allow a cable 22 to pass through the bore 52. The cross-sectional length 56 of the bore 52 can be selected to be larger or smaller depending, at least in part, on an exterior cross-sectional length, e.g., diameter, of the particular cable 22 that may be disposed therethrough and/or how tightly it may be desired for the cable 22 to fit within the bore 52. The cable 22 can have a cross-sectional length, e.g., diameter, of about 0.1 inches, about 0.2 inches, about 0.4 inches, about 0.6 inches, about 0.8 inches, or about 1 inch to about 1.3 inches, about 1.5 inches, about 1.7 inches, about 2 inches, about 2.3 inches, about 2.5 inches, about 2.7 inches, or about 3 inches. In some examples, the cable 22 can have a cross-sectional length, e.g., a diameter, of about 0.1 inches to about 3 inches, about 0.1 inches to about 1 inch, about 0.7 inches to about 1.5 inches, about 1.3 inches to about 2.6 inches, or about 2 inches to about 3 inches.

The first end cap 36 and the second end cap 38 can provide structural support for the first deformable element 40 and the second deformable element 42, respectively, to prevent or otherwise reduce the likelihood of the deformable elements 40, 42 from extruding longitudinally when the packoff seal 10 transitions to an activated state, e.g., pressure is exerted toward the first end cap 36 and/or the second end cap 38 of the packoff seal 10. The first and second end caps 36 and 38 can have lengths, shown by arrows 58 and 60, respectively, which can be the same or different with respect to one another. The end caps 36 and 38 can have the same or different thickness and/or width. The first and second end caps 36, 38 can define bore portions 62 and 64, respectively, which can each form a portion or segment of the bore 52. The bore portions 62 and 64 can be sized such that the cable 22 can pass through the end caps 36 and 38, and can be larger than the cable cross-sectional length.

The first end cap 36 and the second end cap 38 can have a greater compressive strength than the first, second, and third deformable elements 40, 42, and 44, respectively. The end caps 36 and 38 can also be made of a material that can withstand the well or other environment to which the packoff seal 10 may be exposed. In some examples, the end caps 36 and 38 can be made from metal or metal alloys, carbon fiber, or any combination thereof. Illustrative metals can include, but are not limited to, copper, zinc, aluminum, austenitic nickel-chromium based alloys, nickel-iron-chromium based alloys, stainless steel, carbon steel, alloys thereof, or any combination thereof. In some examples, the end caps 36, 38 can be made from brass or stainless steel. In some example, the end caps 36 and 38 can substantially resist deformation when a force is applied to the packoff seal 10. For example, a well pressure can exert or apply a force toward an end of the packoff seal 10, e.g., toward the second end cap 38, and/or by a bellows 30 disposed about the packoff seal 10 that can exert or apply a radially inward force toward the packoff seal 10.

The first insert 46 and second insert 48 can define bore portions 66 and 68, respectively, which can each form a portion or segment of the bore 52. The first and second inserts 46 and 48 can have a length 70 and 72, respectively. The bore portions 66 and 68 can be sized such that the cable 22 can pass through the inserts 46 and 48, and can be larger than the cable cross-sectional length. The first and second inserts 46 and 48 can have a greater compressive strength than the first, second, and third deformable elements 40, 42, and 44. The insert material can be made from a material that can withstand the well or other environment to which the packoff seal 10 may be exposed. In some examples, the first and second inserts 46 and 48 can be made from metal or metal alloys, carbon fiber, or any combination thereof. Illustrative metals can include, but are not limited to, copper, zinc, aluminum, austenitic nickel-chromium based alloys, nickel-iron-chromium based alloys, stainless steel, carbon steel, alloys thereof, or any combination thereof. In some examples, the first and second inserts 46, 48 can be made from brass or stainless steel. The first and second inserts 46 and 48 can have the same or different thickness and/or width with respect to one another. The first and second inserts 46 and 48 can have a strength that can substantially resist deformation when force is applied to the packoff seal, e.g., via well pressure that can exert a force toward an end of the packoff seal 10 and/or by a bellows disposed about the packoff seal 10 that can exert a radially inward force toward the packoff seal 10.

The first deformable element 40, the second deformable element 42, and the third deformable element 44 can define bore portions 74, 76, and 78, respectively, which can each form a portion or segment of the bore 52. The bore portions 62 and 64 defined by the first and second end caps 36, 38, the bore portions 66 and 68 defined by the first and second inserts 46, 48, and the bore portions 74, 76, and 78 defined by the first, second, and third deformable elements 40, 42, and 44 can all at least partially align with one another along the longitudinal axis 54 and can together form the bore 52.

The first deformable element 40 can have a length 80, the second deformable element 42 can have a length 82 and the third deformable element 44 can have a length 84. In some examples, the lengths 80, 82, and 84 can be the same or different with respect to one another. In one example, the length 84 of the third deformable element 44 can be greater than the lengths 80, 82 of the first and second deformable elements 40, 42. For example, the length 84 of the third deformable element 44 can be less than about 4 inches and can be greater than the lengths 80, 82 of the first and second deformable elements 40, 42, which can be less than about 3 inches. In another example, the lengths 80, 82, and 84 of the first, second, and third deformable elements 40, 42, and 44 can each be about the same and can be less than about 3 inches.

The first, second, and third deformable elements, 40, 42, and 44 can each be made from one or more deformable materials. Illustrative deformable materials can be or include, but are not limited to, one or more thermoplastic materials one or more thermoset materials, or any combination thereof. Illustrative deformable materials can be or include, but are not limited to, polyethylene, polyurethane, rubber, crosslinked polyethylene, polyvinyl chloride, polytetrafluoroethylene, ethylene tetrafluoroethylene, tetrafluoroethylene, fluorinated ethylene propylene, a polyimide, modified ethylene tetrafluoroethylene, cresyl phthalate, wax, polyetherketone (PEK), polyether ether ketone (PEEK), polyaryletherketone (PAEK), polyacetylene (PA), polypyrrole (PPY), poly (phenylacetylene) (PPA), poly (p-phenylene sulphide) (PPS), poly (p-phenylene) (PPP), polythiophene (PTP), polyfuran (PFU), polyaniline (PAN), polyisothianaphthene (PIN), fluorinated polyacetylenes, halogen and cyano substituted polyacetylenes, alkoxy-substituted poly (p-phenylenevinylene), poly (5,6-dithiooctyl isothianaphthene, anilne copolymers containing butylthio substituent, butylthioaniline copolymers, cyano-substituted distyryl benzenes, poly (fluorenebenzothiadiazsole-cyanophenylenevinylene), or any combination thereof. Illustrative rubber can be or include, but is not limited to, thermoplastic rubber, neoprene (polychloroprene), styrene butadiene rubber (SBR), silicone, natural rubber, ethylene propylene diene monomer (EPDM), ethylene propylene rubber (EPR), chlorosulfonated polyethylene (CSPE), other thermoset rubber, any other type of rubber, or any combination thereof. In some examples, the deformable material can be or include a polyurethane. The polyurethane can be ether based and/or ester based. The polyurethane can be fully crosslinked (thermoset) or can be a thermoplastic elastomer.

In some examples, the first, second, and/or third deformable elements 40, 42 and 44 can be coated with a low friction material to provide a low friction coating. An illustrative material that can provide a low friction coating can be or include, but is not limited to, polytetrafluoroethylene. In some examples, the first, second, and/or third deformable elements 40, 42, and/or 44 can be made of or include rubber coated with polytetrafluoroethylene and/or polyurethane coated with polytetrafluoroethylene.

In some examples, the first, second, and third deformable elements 40, 42, and 44 can all be made from the same deformable material or the same combination of deformable materials. In other examples, each of the first, second, and third deformable elements 40, 42, and 44 can be made from different deformable materials. In one example, the first and second deformable elements 40 and 42 can be made of a first deformable material, e.g., polyurethane or polytetrafluoroethylene coated rubber, and the third deformable element 44 can be made of another deformable material, e.g., rubber. In another example, the first and second deformable elements 40 and 42 can be made a first deformable material, e.g., rubber or polytetrafluorethylene coated rubber, and the third deformable element 44 can be made of another deformable material, e.g., polyurethane.

In some examples, the packoff seal 10 can include two deformable elements that are separated by a single insert. In other examples, a packoff seal can include 4 or more deformable elements with one or more inserts positioned or otherwise at least partially disposed between two deformable elements. Each deformable element can provide a distinct or separate seal around the cable. For example, the first, second, and third deformable elements 40, 42, and 44 can each provide a seal around the cable 22, where each seal is separate or distinct from one another.

Returning to the packoff assembly 12, the packoff assembly 12 can be used to seal the wellbore 14. The packoff assembly 12 can be connected to the wellhead 18 above ground 20. The packoff assembly 12 can provide a seal around the cable 22. In some examples, the cable 22 can extend between a well servicing tool 24 disposed within the wellbore and a winch or other device (not shown) that can move the cable into and/or out of the wellbore 14. The tool 24 can be positioned within the wellbore 14 and can be raised and lowered within the wellbore 14 to position the tool 24 at different depths within the well 16 as needed during well servicing operations. The seal provided around the cable 22 by the packoff seal 10 can maintain a pressure within the wellbore 14. In some examples, the packoff seal 10 can maintain a pressure of about 100 psi, about 500 psi, about 1,000 psi, about 2,000 psi, about 4,000 psi, about 5,000 psi, or about 6,000 psi to about 8,000 psi, about 10,000 psi, about 12,000 psi, about 13,000 psi, about 14,000 psi, about 15,000 psi, or greater within the wellbore 14.

In some examples, the well pressure can squeeze the packoff seal 10 by applying a longitudinal force, represented by arrows 28, to the end cap 38 that can cause the packoff seal 10 to squeeze, constrict, or otherwise compress around the cable 22. In some examples, the packoff assembly 12 can include one or more bellows 30 disposed about the packoff seal 10. The bellows 30 can apply a radially inward force, represented by arrows 32, which can cause the packoff seal 10 to squeeze, constrict, or otherwise compress around the cable 22. The bellows 30 can be activated automatically, such as based on well pressure, or manually using hydraulic pressure from a hydraulic pump (not shown). In some examples, the well pressure and the bellows 30 can cause the packoff seal 10 to squeeze, constrict, or otherwise compress around the cable 22. The packoff seal 10 can maintain the seal around the cable 22 when the cable is stationary. The packoff seal 10 can maintain the seal around the cable 22 when the cable 22 moves in or out of the well 16 to lower or raise the tool 24.

Figure 4:
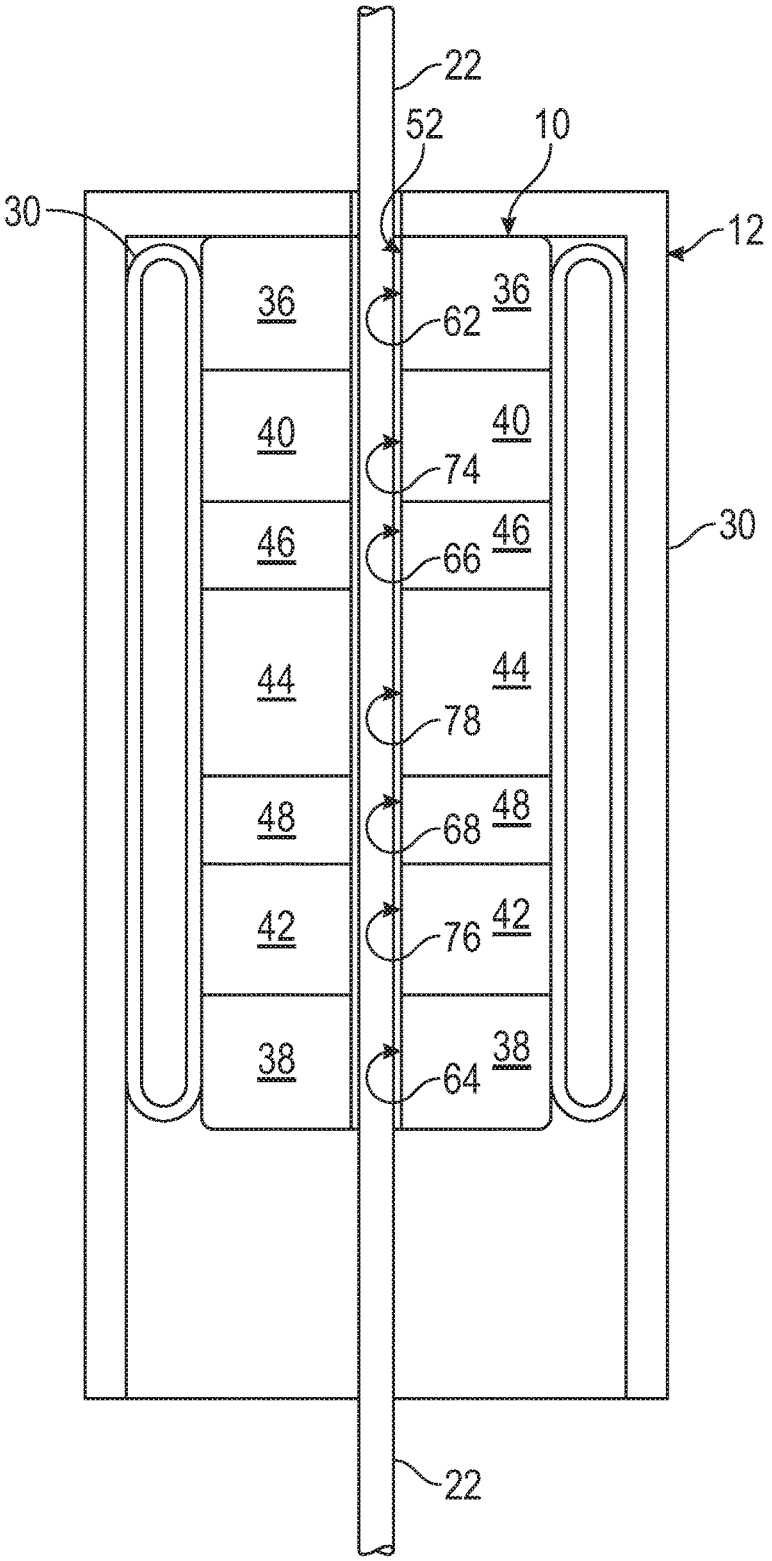
FIG. 4 depicts a cross-sectional view of the packoff assembly that includes the packoff seal shown in FIG. 1 in a non-activated state, according to one or more embodiments described.

FIG. 4 depicts a cross-sectional view of the packoff assembly 12 that includes the packoff seal 10 shown in FIGS. 1-3 in a non-activated state, according to one or more embodiments. In the non-activated state, the packoff assembly 12 may provide limited or no pressure sealing around the cable 22 that can be disposed within the bore 52 of the packoff seal 10. The packoff seal 10 can be self-activating via a well pressure. For example, when there is little or no pressure in the well, there can be little or no pressure applied to the end cap 38 of the packoff seal, and the first, second, and third deformable elements 40, 42, and 44 can be left in a non-deformed or non-activated state. As shown in FIG. 4, when the bellows 30 of the packoff assembly 12 are non-activated, i.e., applying little to no force to the packoff seal 10, the first, second, and third deformable elements 40, 42, and 44 can be left in a non-deformed or non-activated state.

Figure 5:
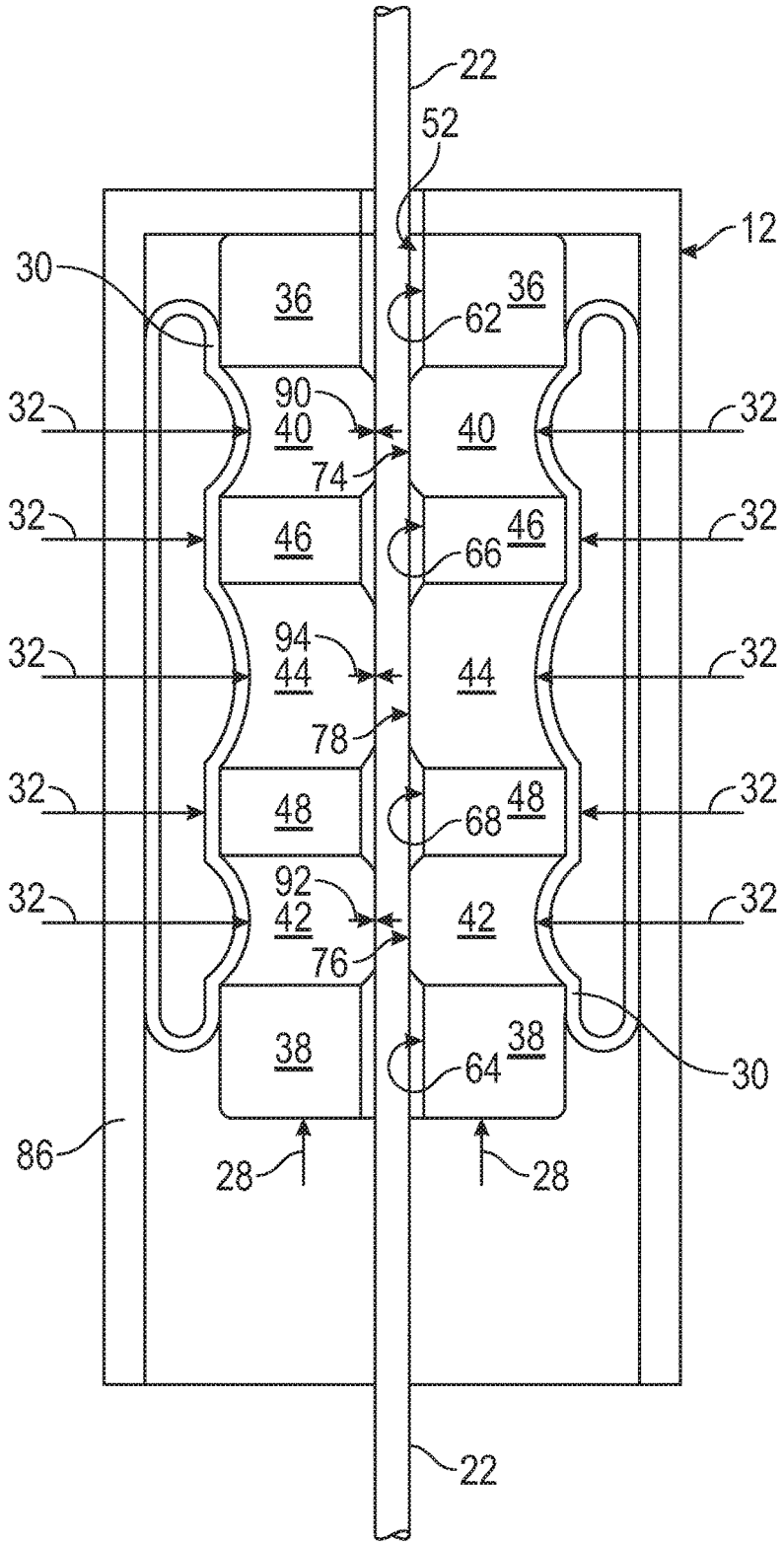
FIG. 5 depicts a cross-sectional view of the packoff assembly that includes the packoff seal shown in FIG. 1 in an activated state, according to one or more embodiments described.

FIG. 5 depicts a cross-sectional view of the packoff assembly 12 that includes the packoff seal 10 shown in FIGS. 1-3 in an activated state, according to one or more embodiments. In the activated state, the packoff assembly 12 can provide a seal around the cable 22. The packoff assembly 12 can activate the bellows 30 to push the bellow material into the first, second, and third deformable elements 40, 42, and 44. The bellows 30 can apply pressure to a wall 86 of the packoff assembly 12, and around the circumference of the packoff seal 10. The wall 86 of the packoff assembly 12 can be rigid, which can direct the force of the bellows 30 radially inward toward the packoff seal 10 as shown by arrows 32. The well pressure can also apply pressure longitudinally to the end cap 38 of the packoff seal 10, as shown by arrows 28. The first and second inserts 46 and 48 and the first and second end caps 36 and 38 can resist the force applied to the packoff seal 10 via the bellows 30 and/or well pressure so that the portions 62 and 64 defined by the first and second end caps 36 and 38 and the bore portions 66 and 68 defined by the first and second inserts 46, 48 remain uncompressed or substantially uncompressed against the cable 22 when the packoff seal 10 is in the activated state.

The first, second, and third deformable elements 40, 42, and 44 can be compressed by the force 32 of the bellows 30 and/or the force 28 of the well pressure such that the first, second, and third deformable elements 40, 42, 44 compress against the cable 22 and form one or more seals therebetween. For example, the packoff seal 10 can create or otherwise form three distinct or separate seals around the cable 22. The first deformable element 40 can compress such that an inner surface of the bore 74 can contact and squeeze around the cable 22 to create or otherwise form a first seal 90 around the cable 22. The second deformable element 42 can compress such that an inner surface of the bore 76 can contact and squeeze around the cable 22 to create or otherwise form a second seal 92 around the cable 22. The third deformable element 44 can compress such that an inner surface of the bore 78 can contact and squeeze around the cable 22 to create or otherwise form a third seal 94 around the cable 22.

The packoff seal 10 can create or otherwise provide a lower contact friction on the cable 22 when in the activated state as compared to a packoff seal including a single deformable element because the overall length of the sealing area contacting the cable can be significantly reduced by having multiple separate inner surfaces of bore portions 74, 76, and 78 contacting the cable 22 rather than a single long inner surface provided by a single deformable element. The force applied by the bellows 30 to the packoff seal 10 can be concentrated or otherwise directed toward the first, second, and third deformable elements 40, 42, and 44 to form or otherwise provide the three seals 90, 92 and 94, rather than spread across a single deformable element having a long sealing area. Packoff seal 10 can achieve the multiple sealing areas utilizing the force 28 from a well pressure on the end cap, a single bellows 30, or a combination of a single bellows 30 and well pressure. The force applied by the three seals can vary and can depend, at least in part, on the force 28 applied by the well pressure and/or the force 32 applied by the bellows 30.

The packoff seal 10 can eliminate, mitigate, or otherwise reduce damage to the third deformable element 44 caused by vibration when the cable 22 moves through the packoff seal 10. For example, the deformable elements 40 and 42 can dampen vibration caused by a high cable velocity and can reduce the likelihood of or prevent the third deformable element 44 from going into a glass transition region from a rubbery region. This can maintain the third deformable element 44 in the rubbery region at high cable speeds and can ensure an effective seal even if one or both of the first and second deformable elements 40, 42 happen to suffer vibrational damage during use. Maintaining the third deformable element 44 in the rubbery region can extend the useful lifetime of the packoff seal 10 and can minimize the chance of losing the seal around the cable 22 while running multiple well servicing operations with the same packoff seal 10.

As noted above, in some examples, the third deformable element 44 and the first and second deformable elements 40 and 42 may be composed of the same or different types of rubber, thermoplastic elastomers like polyurethane, or other suitable thermoplastic materials. Rubbers and polyurethanes having different durometer hardness may be used for the third deformable element 44 and the deformable elements 40 and 42 to improve sealing, vibration damping capacity, and/or resistance to going into the glass transition region. In other examples, the third deformable element 44 and the first and second deformable elements 40 and 42 can be made from the same material, such as coated or uncoated rubber or polyurethane which can be ether or ester based and may be fully crosslinked or a thermoplastic elastomer. All or a portion of the material can be coated with polytetrafluoroethylene (PTFE) or other low friction coating.

In some examples, the third deformable element 44 can be made from a first material and the first and second deformable elements 40 and 42 can be made from a second, different material. In some examples, the first material can be rubber while the second material can be polyurethane or coated rubber; or the first material can be polyurethane and the second material can be coated or uncoated rubber; or the first material can be coated rubber and the second material can be rubber or polyurethane. In some examples, the first and second deformable elements 40 and 42 can be polyurethane or rubber coated with polytetrafluoroethylene and the third deformable element 44 can be uncoated rubber.

The bore 52 of the packoff seal 10 is shown in FIG. 4 as having a diameter 56, when the packoff assembly 12 is in the non-activated state that is slightly larger than the exterior diameter of the cable 22 so that the cable 22 can pass through the bore 52 without substantial contact. It should be understood that the bore portions 74, 76, and 78 defined by the first, second, and third deformable elements 40, 42, and 44 can have the same diameter (or other cross-sectional shape) as the cable 22 so that the cable 22 contacts the inner surface of the bore portions 74, 76, and 78 when the packoff seal 10 is in the non-activated state. In some examples, the bore portions 74, 76, and 78 can have a slightly smaller diameter (or other cross-sectional shape) than the cable 22 so that the packoff seal 10 compresses against the cable 22 when the packoff seal 10 is in the non-activated state. The bore portions 62, 64 defined by the first and second end caps 36, 38, the bore portions 66 and 68 defined by the first and second inserts 46, 48, and the bore portions 74, 76, and 78 defined by the first, second, and third deformable elements 40, 42, and 44 can all have the same or different diameters (or other cross-sectional lengths) with respect to one another, and some can have the same diameter (or other cross-sectional length) while others have different diameters (or other cross-sectional lengths). In some examples, the bore portions 62, 64 defined by the first and second end caps 36, 38, the bore portions 66 and 68 defined by the first and second inserts 46, 48 can have a diameter (or other cross-sectional length) that can be greater than the exterior diameter of the cable 22.

Figure 6:
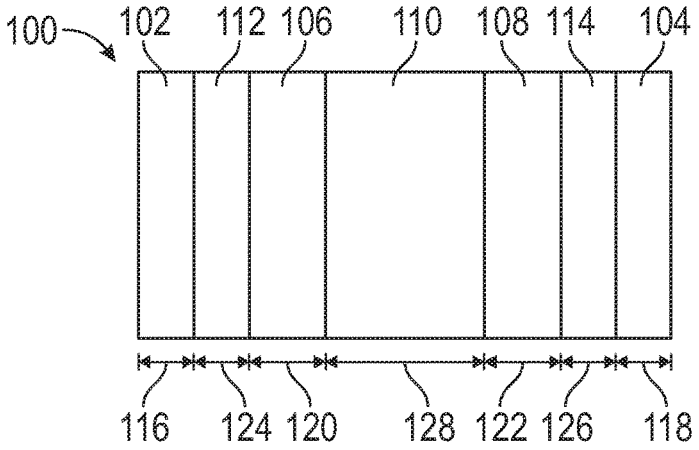
FIG. 6 depicts a cross-sectional view of another illustrative packoff seal, according to one or more embodiments described.

FIG. 6 depicts a cross-sectional view of another illustrative packoff seal 100, according to one or more embodiments. The packoff seal 100 can include a first end cap 102 and a second end cap 104, a first insert 106 and a second insert 108, a first deformable element 112, second deformable element 114, and a third deformable element 110. The first end cap 102 can have a first end cap length 116 and the second end cap 104 can have a second end cap length 118. The first insert 106 can have a first insert length 120 and the second insert 108 can have a second insert length 122. The first deformable element 112 can have a first deformable element length 124, the second deformable element 114 can have a second deformable element length 126, and the third deformable element 110 can have a third deformable element length 128. In some examples, the lengths 124 and 126 of the first and second deformable elements 112, 114, respectively, can be the same or different. In some examples, the length 128 of the third deformable element 110 can be greater than, less than, or the same as the lengths 124 and 126 of the first and second deformable elements 112, 114. In some examples, the length 128 of the third deformable element 110 can be about 3 inches to about 4 inches and the lengths 124 and 126 of the first and second deformable elements 112, 114, respectively, can be less than three inches.

Figure 7:
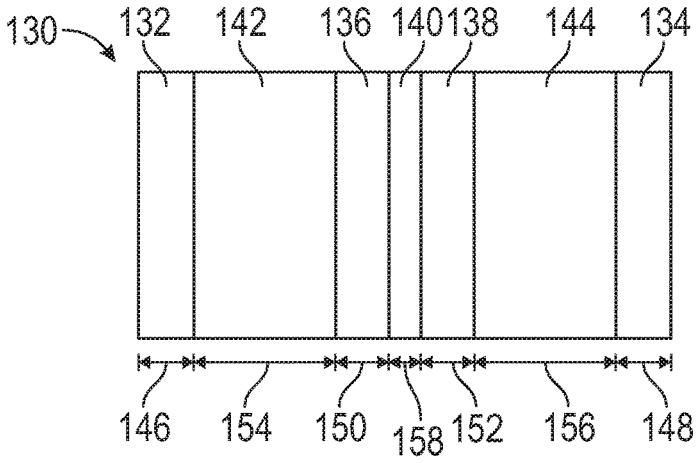
FIG. 7 depicts a cross-sectional view of another illustrative packoff seal, according to one or more embodiments described.

FIG. 7 depicts a cross-sectional view of another illustrative packoff seal 130, according to one or more embodiments. The packoff seal 130 can include a first end cap 132 and a second end cap 134, a first insert 136 and a second insert 138, a first deformable element 142, a second deformable element 144, and a third deformable element 140. The first end cap 132 can have a first end cap length 146 and the second end cap 134 can have a second end cap length 148. The first insert 136 can have a first insert length 150 and the second insert 138 can have a second insert length 152. The first deformable element 142 can have a first deformable element length 154, the second deformable element 144 can have a second deformable element length 156, and the third deformable element 140 can have a third deformable element length 158. In some examples, the length 158 of the third deformable element 140 can be less than the lengths 154, 156 of the first and/or the second deformable elements 142, 144, respectively. In another example, the length 158 of the third deformable element 140 can be less than 3 inches and the lengths 154, 156 of the first and second deformable elements 142, 144, respectively, can be about 3 inches to about 4 inches. In another example, the length 158 of the third deformable element 140 can be the same as the lengths 154, 156 of the first and second deformable elements 142, 144, respectively. The lengths 146 and 148 of the first and second end caps 132, 134, respectively, can be the same or different from one another. The lengths 150, 152 of the first and second inserts 136, 138 can be the same or different from one another, and/or the same or different from the lengths 146 and 148 of the first and second end caps 132, 134, respectively.

Figure 8:
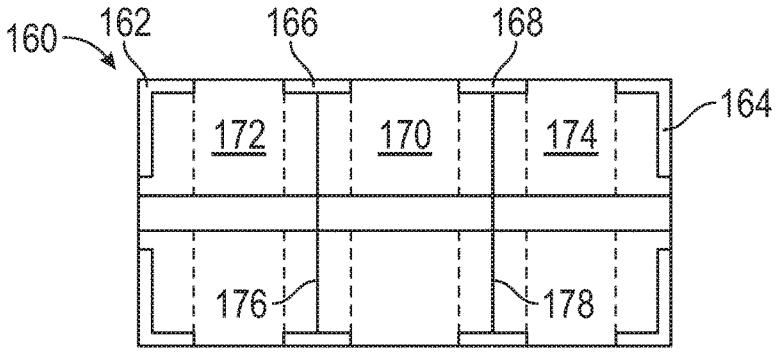
FIG. 8 depicts a cross-sectional view of yet another illustrative packoff seal, according to one or more embodiments described.

FIG. 8 depicts a cross-sectional view of yet another illustrative packoff seal 160, according to one or more embodiments. The packoff seal 160 can include a first end cap 162 and a second end cap 164, a first insert 166 and a second insert 168, a center core portion 170, and a first end core portion 172 and second end core portion 174. The center core portion 170 and the first and second end core portions 172 and 174 can be composed of the same or different types of deformable material(s). The deformable materials can be adjacent to each other along surfaces 176 and 178. In other examples, the center core portion 170, the first end core portion 172, and the second end core portion 174 can be an integral or contiguous body of deformable material defining a bore therethrough similar to the bore 52 discussed and described above. As shown, the first insert 166 can be in the form of an annular ring that can be disposed about an outer surface of a portion of the first end core portion 172 and a first portion of the center core portion 170. Similarly, as shown, the second insert 168 can be in the form of an annular ring that can be disposed about an outer surface of a portion of the second end core portion 174 and a second portion of the center core portion 170.

Dual packoff assemblies can include two packoff seals in series along the cable to provide an added measure of safety. It should be understood that the embodiments and features described herein can be applied to packoff seals used in dual packoff assemblies.

Embodiments of the present disclosure further relate to any one or more of the following paragraphs:

1. A packoff seal, comprising: a first end cap and a second end cap; a first insert and a second insert; a first deformable element disposed between the first end cap and the first insert; a second deformable element disposed between the second insert and the second end cap; and a third deformable element disposed between the first insert and the second insert, wherein: the first end cap, the first deformable element, the first insert, the third deformable element, the second insert, the second deformable element, and the second end cap together form a body having a bore extending therethrough, and wherein the first deformable element, the second deformable element, and the third deformable element have a compressive strength that is less than a compressive strength of the first and second inserts.

2. The packoff seal according to paragraph 1, wherein first deformable element has a length defined between the first end cap and the first insert, the second deformable element has a length defined between the second end cap and the second insert, and the third deformable element has a length defined between the first insert and the second insert, and wherein the length of the third deformable element is greater than the length of the first deformable element and the length of the second deformable element.

3. The packoff seal according to paragraph 2, wherein the length of the third deformable element is about 3 inches to about 4 inches, and wherein the length of the first deformable element and the length of the second deformable element are each less than 3 inches.

4. The packoff seal according to paragraph 1, wherein the first deformable element has a length defined between the first end cap and the first insert, the second deformable element has a length defined between the second end cap and the second insert, and the third deformable element has a length defined between the first insert and the second insert, and wherein the length of the third deformable element, the length of the second deformable element, and the length of the third deformable element are substantially the same.

5. The packoff seal according to paragraph 4, wherein the length of the first deformable element, the length of the second deformable element, and the length of the third deformable element are each less than 3 inches.

6. The packoff seal according to paragraph 1, wherein the first deformable element has a length defined between the first end cap and the first insert, the second deformable element has a length defined between the second end cap and the second insert, and the third deformable element has a length defined between the first insert and the second insert, and wherein the length of the first deformable element and the length of the second deformable element are greater than the length of the third deformable element.

7. The packoff seal according to paragraph 6, wherein the length of the first deformable element and the length of the second deformable element are each about 3 inches to about 4 inches and the length of the third deformable element is less than 3 inches.

8. The packoff seal according to any one of paragraphs 1 to 7, wherein at least one of the first deformable element, the second deformable element, and the third deformable element is made of rubber.

9. The packoff seal according to any one of paragraphs 1 to 7, wherein at least one of the first deformable element, the second deformable element, and the third deformable element is made of rubber coated with a friction reducing material.

10. The packoff seal according to any one of paragraphs 1 to 7, wherein at least one of the first deformable element, the second deformable element, and the third deformable element is made of polyurethane.

11. The packoff seal according to any one of paragraphs 1 to 7, wherein the first deformable element and the second deformable element are made of a first material, wherein the third deformable element is made of a second material, and wherein the first material is different than the second material.

12. The packoff seal according to paragraph 11, wherein the first material comprises rubber and the second material comprises polyurethane.

13. The packoff seal according to any one of paragraphs 1 to 12, wherein the first deformable element is configured to deform in response to a force to form a first seal around a cable disposed through the bore, the second deformable element is configured to deform in response to the force to form a second seal around the cable and the third deformable element is configured to deform in response to the force to form a third seal around the cable.

14. The packoff seal according to paragraph 13, wherein the first, second and third seals are separate from one another.

15. The packoff seal according to paragraph 13 or 14, wherein the first seal has a first seal length along a length of the cable where the first deformable element contacts the cable, the second seal has a second seal length along a length of the cable where the second deformable element contacts the cable, and the third seal has a third seal length along a length of the cable where the third deformable element contacts the cable.

16. The packoff seal according to paragraph 15, wherein the third seal length is about 3 to about 4 inches and the first and second seal lengths are each less than 3 inches.

17. A packoff assembly, comprising: a packoff seal, comprising: a first end cap and a second end cap; a first insert and a second insert; a first deformable element disposed between the first end cap and the first insert; a second deformable element disposed between the second insert and the second end cap; and a third deformable element disposed between the first insert and the second insert, wherein: the first end cap, the first deformable element, the first insert, the third deformable element, the second insert, the second deformable element, and the second end cap together form a body having a bore extending therethrough, and wherein the first end cap is configured to receive a longitudinal force from a well pressure along a longitudinal axis of the packoff seal, the first and second inserts are configured to resist the longitudinal force and the first, second, and third deformable elements are configured to deform in response to the longitudinal force to form three separate seals around a cable disposed within the bore, or wherein a bellows is disposed about the packoff seal and configured to apply a force radially inward to the packoff seal, the first and second inserts configured to resist the radially inward force and the first, second, and third deformable elements configured to deform in response to the radially inward force to form three separate seals around the cable disposed within the bore.

18. A packoff assembly, comprising: a packoff seal, comprising: a first end cap and a second end cap; a first insert and a second insert; a first deformable element disposed between the first end cap and the first insert; a second deformable element disposed between the second insert and the second end cap; and a third deformable element disposed between the first end cap and the second end cap, wherein: the first end cap, the first deformable element, the first insert, the third deformable element, the second insert, the second deformable element, and the second end cap together form a body having a bore extending therethrough, and wherein the first end cap is configured to receive a longitudinal force from a well pressure along a longitudinal axis of the packoff seal, the first and second inserts are configured to resist the longitudinal force and the first, second, and third deformable elements are configured to deform in response to the longitudinal force to form three separate seals around a cable disposed within the bore.

19. The packoff assembly according to paragraph 18, wherein a bellows is disposed about the pack off seal and configured to apply a force radially inward to the pack off seal, the first and second inserts configured to resist the radially inward force and the first, second, and third deformable elements configured to deform in response to the radially inward force to form three separate seals around the cable disposed within the bore.

20. A packoff assembly, comprising: a packoff seal, comprising: a first end cap and a second end cap; a first insert and a second insert; a first deformable element disposed between the first end cap and the first insert; a second deformable element disposed between the second insert and the second end cap; and a third deformable element disposed between the first end cap and the second end cap, wherein: the first end cap, the first deformable element, the first insert, the third deformable element, the second insert, the second deformable element, and the second end cap together form a body having a bore extending therethrough, and wherein a bellows is disposed about the packoff seal and configured to apply a force radially inward to the packoff seal, the first and second inserts configured to resist the radially inward force and the first, second, and third deformable elements configured to deform in response to the radially inward force to form three separate seals around the cable disposed within the bore.

21. The packoff assembly according to paragraph 20, wherein the first end cap is configured to receive a longitudinal force from a well pressure along a longitudinal axis of the pack off seal, the first and second inserts are configured to resist the longitudinal force and the first, second, and third deformable elements are configured to deform in response to the longitudinal force to form three separate seals around the cable disposed within the bore.

22. The packoff assembly according to any one of paragraphs 17 to 21, wherein two of the deformable elements are made of a first material and the other deformable element is made of a second material, and wherein the first material and the second material are different from one another.

23. The packoff assembly according to paragraph 22, wherein one of the first material and the second material is rubber and the other is polyurethane.

24. The packoff assembly according to paragraph 23, wherein the rubber is coated with a friction reducing material.

25. The packoff assembly according to any one of paragraph 17 to 24, wherein the first and second inserts and the first and second end caps are made of brass.

26. The packoff assembly according to any one of paragraphs 17 to 25, wherein first deformable element has a length defined between the first end cap and the first insert, the second deformable element has a length defined between the second end cap and the second insert, and the third deformable element has a length defined between the first insert and the second insert, and wherein the length of the third deformable element is greater than the length of the first deformable element and the length of the second deformable element.

27. The packoff assembly according to paragraph 26, wherein the length of the third deformable element is about 3 inches to about 4 inches, and wherein the length of the first deformable element and the length of the second deformable element are each less than 3 inches.

28. The packoff assembly according to any one of paragraphs 17 to 25, wherein the first deformable element has a length defined between the first end cap and the first insert, the second deformable element has a length defined between the second end cap and the second insert, and the third deformable element has a length defined between the first insert and the second insert, and wherein the length of the third deformable element, the length of the second deformable element, and the length of the third deformable element are substantially the same.

29. The packoff assembly according to paragraph 28, wherein the length of the first deformable element, the length of the second deformable element, and the length of the third deformable element are each less than 3 inches.

30. The packoff assembly according to any one of paragraphs 17 to 25, wherein the first deformable element has a length defined between the first end cap and the first insert, the second deformable element has a length defined between the second end cap and the second insert, and the third deformable element has a length defined between the first insert and the second insert, and wherein the length of the first deformable element and the length of the second deformable element are greater than the length of the third deformable element.

31. The packoff assembly according to paragraph 30, wherein the length of the first deformable element and the length of the second deformable element are each about 3 inches to about 4 inches and the length of the third deformable element is less than 3 inches.

32. The packoff assembly according to any one of paragraphs 17 to 21, wherein at least one of the first deformable element, the second deformable element, and the third deformable element is made of rubber.

33. The packoff assembly according to any one of paragraphs 17 to 21, wherein at least one of the first deformable element, the second deformable element, and the third deformable element is made of rubber coated with a friction reducing material.

34. The packoff assembly according to any one of paragraphs 17 to 21, wherein at least one of the first deformable element, the second deformable element, and the third deformable element is made of polyurethane.

35. A process for servicing a wellbore, comprising: arranging a packoff assembly comprising one or more packoff seals around a cable; extending the cable into the wellbore to move a tool connected thereto in the wellbore; and applying a force to at least one of the one or more packoff seals to compress at least three deformable elements in the at least one of the one or more packoff seals against the cable, wherein the at least three deformable elements form separate seals around the cable when the force is applied to the packoff seal.

36. The process according to paragraph 35, wherein the force is applied by a bellows.

37. The process according to paragraph 35, wherein the force is applied by a well pressure.

38. The process according to paragraph 35, wherein the force is applied by a well pressure and a bellows.

39. The process according to any one of paragraphs 35 to 38, wherein the at least one of the one or more packoff seals comprises a first end cap and a second end cap, a first insert and a second insert, a first deformable element disposed between the first end cap and the first insert, a second deformable element disposed between the second insert and the second end cap, and a third deformable element disposed between the first insert and the second insert.

40. The process according to paragraph 39, wherein the first end cap, the first deformable element, the first insert, the third deformable element, the second insert, the second deformable element, and the second end cap together form a body having a bore extending therethrough.

41. The process according to paragraph 39 or 40, wherein the first deformable element, the second deformable element, and the third deformable element have a compressive strength that is less than a compressive strength of the first and second inserts.

42. The process according to any one of paragraphs 39 to 41, wherein first deformable element has a length defined between the first end cap and the first insert, the second deformable element has a length defined between the second end cap and the second insert, and the third deformable element has a length defined between the first insert and the second insert, and wherein the length of the third deformable element is greater than the length of the first deformable element and the length of the second deformable element.

43. The process according to paragraph 42, wherein the length of the third deformable element is about 3 inches to about 4 inches, and wherein the length of the first deformable element and the length of the second deformable element are each less than 3 inches.

44. The process according to any one of paragraphs 39 to 41, wherein the first deformable element has a length defined between the first end cap and the first insert, the second deformable element has a length defined between the second end cap and the second insert, and the third deformable element has a length defined between the first insert and the second insert, and wherein the length of the third deformable element, the length of the second deformable element, and the length of the third deformable element are substantially the same.

44. The process according to paragraph 44, wherein the length of the first deformable element, the length of the second deformable element, and the length of the third deformable element are each less than 3 inches.

45. The process according to any one of paragraphs 39 to 41, wherein the first deformable element has a length defined between the first end cap and the first insert, the second deformable element has a length defined between the second end cap and the second insert, and the third deformable element has a length defined between the first insert and the second insert, and wherein the length of the first deformable element and the length of the second deformable element are greater than the length of the third deformable element.

46. The process according to paragraph 45, wherein the length of the first deformable element and the length of the second deformable element are each about 3 inches to about 4 inches and the length of the third deformable element is less than 3 inches.

47. The process according to any one of paragraphs 39 to 46, wherein at least one of the first deformable element, the second deformable element, and the third deformable element is made of rubber.

48. The process according to any one of paragraphs 39 to 46, wherein at least one of the first deformable element, the second deformable element, and the third deformable element is made of rubber coated with a friction reducing material.

49. The process according to any one of paragraphs 39 to 46, wherein at least one of the first deformable element, the second deformable element, and the third deformable element is made of polyurethane.

50. The process according to any one of paragraphs 39 to 46, wherein the first deformable element and the second deformable element are made of a first material, wherein the third deformable element is made of a second material, and wherein the first material is different than the second material.

51. The process according to paragraph 50, wherein the first material comprises rubber and the second material comprises polyurethane.

52. The process according to paragraph 50, wherein the first material comprises polyurethane and the second material comprises rubber.

Although the preceding description has been described herein with reference to particular means, materials, and embodiments, it is not intended to be limited to the particulars disclosed herein; rather, it extends to all functionally equivalent structures, processes, and uses, such as are within the scope of the appended claims.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A packoff seal, comprising:

a first end cap and a second end cap;

a first insert and a second insert;

a first deformable element disposed between the first end cap and the first insert;

a second deformable element disposed between the second insert and the second end cap; and a third deformable element disposed between the first insert and the second insert, wherein:

the first end cap, the first deformable element, the first insert, the third deformable element, the second insert, the second deformable element, and the second end cap together form a body having a bore extending therethrough, and wherein the first deformable element, the second deformable element, and the third deformable element have a compressive strength that is less than a compressive strength of the first and second inserts;

wherein the first end cap is configured to receive a longitudinal force from a pressure source along a longitudinal axis of the packoff seal and the first, second, and third deformable elements are configured to deform in response to the longitudinal force to form at least one seal around a cable disposed within the bore.

2. The packoff seal of claim 1, wherein first deformable element has a length defined between the first end cap and the first insert, the second deformable element has a length defined between the second end cap and the second insert, and the third deformable element has a length defined between the first insert and the second insert, and wherein the length of the third deformable element is greater than the length of the first deformable element and the length of the second deformable element.

3. The packoff seal of claim 2, wherein the length of the third deformable element is about 3 inches to about 4 inches, and wherein the length of the first deformable element and the length of the second deformable element are each less than 3 inches.

4. The packoff seal of claim 1, wherein the first deformable element has a length defined between the first end cap and the first insert, the second deformable element has a length defined between the second end cap and the second insert, and the third deformable element has a length defined between the first insert and the second insert, and wherein the length of the third deformable element, the length of the second deformable element, and the length of the third deformable element are substantially the same.

5. The packoff seal of claim 4, wherein the length of the first deformable element, the length of the second deformable element, and the length of the third deformable element are each less than 3 inches.

6. The packoff seal of claim 1, wherein the first deformable element has a length defined between the first end cap and the first insert, the second deformable element has a length defined between the second end cap and the second insert, and the third deformable element has a length defined between the first insert and the second insert, and wherein the length of the first deformable element and the length of the second deformable element are greater than the length of the third deformable element.

7. The packoff seal of claim 6, wherein the length of the first deformable element and the length of the second deformable element are each about 3 inches to about 4 inches and the length of the third deformable element is less than 3 inches.

8. The packoff seal of claim 1, wherein at least one of the first deformable element, the second deformable element, and the third deformable element is made of rubber.

9. The packoff seal of claim 1, wherein at least one of the first deformable element, the second deformable element, and the third deformable element is made of rubber coated with a friction reducing material.

10. The packoff seal of claim 1, wherein at least one of the first deformable element, the second deformable element, and the third deformable element is made of polyurethane.

11. The packoff seal of claim 1, wherein the first deformable element and the second deformable element are made of a first material, wherein the third deformable element is made of a second material, and wherein the first material is different than the second material.

12. The packoff seal of claim 11, wherein the first material comprises rubber and the second material comprises polyurethane.

13. A packoff assembly, comprising:

a packoff seal, comprising:

a first end cap and a second end cap;

a first insert and a second insert;

a first deformable element disposed between the first end cap and the first insert;

a second deformable element disposed between the second insert and the second end cap; and a third deformable element disposed between the first insert and the second insert, wherein:

the first end cap, the first deformable element, the first insert, the third deformable element, the second insert, the second deformable element, and the second end cap together form a body having a bore extending therethrough, and wherein the first end cap is configured to receive a longitudinal force from a well pressure along a longitudinal axis of the packoff seal, the first and second inserts are configured to resist the longitudinal force and the first, second, and third deformable elements are configured to deform in response to the longitudinal force to form three separate seals around a cable disposed within the bore, and wherein a bellows is disposed about the packoff seal and configured to apply a force radially inward to the packoff seal, the first and second inserts configured to resist the radially inward force and the first, second, and third deformable elements configured to deform in response to the radially inward force to form three separate seals around the cable disposed within the bore.

14. The packoff assembly of claim 13, wherein two of the deformable elements are made of a first material and the other deformable element is made of a second material, wherein the first material and the second material are different from one another.

15. The packoff assembly of claim 14, wherein one of the first material and the second material is rubber and the other is polyurethane.

16. The packoff assembly of claim 15, wherein the rubber is coated with a friction reducing material.

17. The packoff assembly of claim 13, wherein the first and second inserts and the first and second end caps are made of brass.

18. A method for servicing a wellbore, comprising:

arranging a packoff assembly comprising one or more packoff seals separated by at least one insert around a cable;

extending the cable into the wellbore to move a tool connected thereto in the wellbore; and applying a force to at least one of the one or more packoff seals and the at least one insert to compress at least three deformable elements in the at least one of the one or more packoff seals against the cable, wherein the at least three deformable elements form separate seals around the cable when the force is applied to the packoff seal;

wherein the one or more packoff seals are configured to be compressed in a longitudinal direction along a longitudinal axis of the packoff assembly.

19. The method of claim 18, wherein the force is applied by a bellows.

20. The method of claim 18, wherein the force is applied by a well pressure.

* * * * *